US009966011B2

(12) United States Patent
Chen et al.

(10) Patent No.: US 9,966,011 B2
(45) Date of Patent: May 8, 2018

(54) TV SET, METHOD OF CONTROLLING BACKLIGHT OF LIQUID CRYSTAL PANEL AND STORAGE MEDIUM

(71) Applicants: HISENSE HIVIEW TECH CO., LTD., Qingdao, Shandong (CN); HISENSE USA CORPORATION, Suwanee (GA)

(72) Inventors: Xingfeng Chen, Shandong (CN); Weidong Liu, Shandong (CN); Mingsheng Qiao, Shandong (CN)

(73) Assignees: Hisense Electric Co., Ltd., Qingdao, Shandong (CN); Hisense USA Corporation, Suwanee (GA)

( * ) Notice: Subject to any disclaimer, the term of this patent is extended or adjusted under 35 U.S.C. 154(b) by 0 days. days.

(21) Appl. No.: 14/511,372

(22) Filed: Oct. 10, 2014

(65) Prior Publication Data

US 2015/0029237 A1 Jan. 29, 2015

Related U.S. Application Data

(63) Continuation of application No. PCT/CN2012/079535, filed on Aug. 1, 2012.

(30) Foreign Application Priority Data

Apr. 17, 2012 (CN) ..... 2012 1 0112757

(51) Int. Cl.
*G09G 3/34* (2006.01)
*G09G 3/36* (2006.01)

(52) U.S. Cl.
CPC ..... *G09G 3/3406* (2013.01); *G09G 3/3413* (2013.01); *G09G 3/3611* (2013.01);
(Continued)

(58) Field of Classification Search
CPC ..... G09G 3/22; G09G 3/2003; G09G 3/3406; G09G 3/3426; G09G 3/3611;
(Continued)

(56) References Cited

U.S. PATENT DOCUMENTS

2007/0001997 A1* 1/2007 Kim ..... G09G 3/3406 345/102
2007/0285379 A1 12/2007 Jung et al.
(Continued)

FOREIGN PATENT DOCUMENTS

CN 1625763 A 6/2005
CN 100358001 12/2007
(Continued)

OTHER PUBLICATIONS

Chinese Appln. No. 201210112757.0, First Office Action, 8 pages, Enghsh translation, 14 pages.
(Continued)

*Primary Examiner* — Nalini Mummalaneni
(74) *Attorney, Agent, or Firm* — Boyle Fredrickson, S.C.

(57) ABSTRACT

A TV set including a liquid crystal panel, a processor-readable storage medium storing instruction units for providing the TV set functions to control backlight of the liquid crystal panel; and one or more processors in communication with the storage medium to execute the instruction units, wherein the instruction units include: an image information amount determining unit (102); the backlight gain retrieving unit (104); a backlight value extracting unit (106); the backlight value processing unit (108); and a backlight value transmitting unit (110). Correspondingly a method of controlling backlight of a liquid crystal panel is further disclosed. In the technical solution of the disclosure, a backlight modulation coefficient can be modulated dynamically according to the amount of image information to perform
(Continued)

backlight enhancement on an image with a large amount of information.

15 Claims, 3 Drawing Sheets

(52) U.S. Cl.
CPC ..... *G09G 2320/0271* (2013.01); *G09G 2320/0646* (2013.01); *G09G 2320/0653* (2013.01); *G09G 2360/16* (2013.01)

(58) Field of Classification Search
CPC ..... G09G 3/3413; G09G 3/342; G09G 3/36; G09G 3/3607; G09G 3/3648; G09G 5/02; G09G 5/06; G09G 5/04; G09G 5/10; G09G 2320/0646; G09G 2320/0271; G09G 2320/0233; G09G 2320/0666; G09G 2320/064; G09G 2320/066; G09G 2320/0242; G09G 2320/0626; G09G 2320/0653; G09G 2320/0673; G09G 2320/0276; G09G 2320/0238; G09G 2320/02; G09G 2320/0285; G09G 2320/062; G09G 2320/103; G09G 2320/043; G09G 2320/0686; G09G 2320/0633; G09G 2300/0452; G09G 2310/024; G09G 2310/0237; G09G 2330/021; G09G 2340/0435; G09G 2340/06; G09G 2340/16; G09G 2340/0428; G09G 2360/145; G09G 2360/16; H04N 5/57; H04N 5/2352; H04N 9/68; H04N 9/643
See application file for complete search history.

(56) References Cited

U.S. PATENT DOCUMENTS

2010/0149224 A1* 6/2010 Baba ..... G09G 3/3413 345/690
2010/0283802 A1* 11/2010 Jung ..... G09G 3/3426 345/690
2011/0141090 A1* 6/2011 Hong ..... G09G 3/3426 345/211
2011/0141166 A1* 6/2011 Ahn ..... G09G 3/3426 345/691
2011/0205442 A1* 8/2011 Mori ..... G09G 3/3208 348/673
2013/0016141 A1* 1/2013 Chang ..... G09G 3/3426 345/691
2013/0222221 A1* 8/2013 An ..... G09G 3/3426 345/102

FOREIGN PATENT DOCUMENTS

CN 101271208 9/2008
CN 101271208 A 9/2008
CN 101281730 10/2008
CN 101383132 3/2009
CN 101383132 A 3/2009
CN 101826282 9/2010
CN 102239513 11/2011
CN 102622990 A 8/2012
JP WO 2010067816 A1 * 6/2010 ..... G09G 3/3208
JP 2011-85693 4/2011
KR 10-0759902 9/2007

OTHER PUBLICATIONS

Chinese Appln. No. 201210112757.0, Second Office Action, 9 pages, English translation, 15 pages.
Chinese Appln. No. 201210112757.0, Third Office Action, 3 pages, English tanslalion, 5 pages.
Chinese Appln. No. 20120112757.0, Search Report dated Mar. 3, 2017, 2 pages.

* cited by examiner

TV SET, METHOD OF CONTROLLING BACKLIGHT OF LIQUID CRYSTAL PANEL AND STORAGE MEDIUM

CROSS-REFERENCE TO RELATED APPLICATIONS

The present application claims priority to and is a continuation of international Patent Application PCT/CN2012/079535, which claims priority to Chinese Patent Application No. 201210112757.0, filed on Apr. 17, 2012 in the People's Republic of China, entitled "APPARATUS AND METHOD OF CONTROLLING BACKLIGHT OF LIQUID CRYSTAL PANEL, TV SET, MACHINE-READABLE PROGRAM AND STORAGE MEDIUM THEREOF", the contents of which is hereby incorporated by reference in its entirety.

BACKGROUND OF THE INVENTION

The present disclosure relates to the field of liquid crystal screen backlight modulation and particularly to an apparatus for controlling backlight of a liquid crystal panel, a TV set and a method of controlling backlight of a liquid crystal panel.

Internet TV, intelligent TV, etc., have constantly been coming into view of audiences along with constant development of TV technologies. But the visual effect of prior arts can not satisfy at least a part of the audiences.

BRIEF SUMMARY OF THE INVENTION

In view of this, the disclosure provides a TV set including a liquid crystal panel, a processor-readable storage medium storing instruction units for providing the TV set functions to control backlight of the liquid crystal panel; and one or more processors in communication with the storage medium to execute the instruction units, wherein the instruction units include: an image information amount determining unit configured to determine an amount of image information of an input video signal and to transmit the amount of image information to a backlight gain retrieving unit; the backlight gain retrieving unit, in communication with the image information amount determining unit, configured to retrieve a backlight gain coefficient according to the amount of image information; a backlight value extracting unit configured to extract a backlight value of the video signal and to transmit the backlight value to a backlight value processing unit; the backlight value processing unit, in communication with the backlight value extracting unit and the backlight gain retrieving unit, configured to calculate a gained backlight value from the backlight gain coefficient and the backlight value; and a backlight value transmitting unit, in communication with the backlight value processing unit, configured to transmit the gained backlight value to a light source drive circuit of a liquid crystal panel.

In the technical solutions above, preferably the backlight gain retrieving unit includes a memory configured to store amounts of image information and backlight gain coefficients in correspondence with each other, and the backlight gain retrieving unit is configured to search the memory for the backlight gain coefficient according to the amount of image information determined by the image information amount determining unit.

In the technical solutions above, preferably the backlight value processing unit is configured to calculate the gained backlight value according to an equation of $f(x)=k(\alpha)\times x$, wherein $f(x)$ represents the gained backlight value, $\alpha$ represents the amount of image information, $k(\alpha)$ represents the backlight gain coefficient, and $x$ represents the backlight value extracted by the backlight value extracting unit.

In the technical solutions above, preferably the instruction units can further includes an image compensating unit, in communication with the backlight processing unit, configured to compensate the received video signal according to the received gained backlight value.

In the technical solutions above, preferably the instruction units can further includes a data receiving unit and a data transmitting unit, wherein the data receiving unit is in communication with the image information amount determining unit, the backlight value extracting unit and the image compensating unit, and the data transmitting unit is in communication with the image compensating unit, wherein the video signal is received from outside through the data receiving unit and the video signal compensated by the image compensating unit is transmitted to a timing control unit of the liquid crystal panel.

According to another aspect of the disclosure, there is further provided a method of controlling backlight of a liquid crystal panel, applicable to a terminal with an apparatus for controlling backlight of a liquid crystal panel, the method including: a step 202 of determining an amount of image information of an input video signal and extracting a backlight value of the video signal; a step 204 of retrieving a backlight gain coefficient according to the amount of image information; a step 206 of calculating a gained backlight value from the backlight gain coefficient and the backlight value; and a step 208 of transmitting the gained backlight value to a light source drive circuit of a liquid crystal panel to control backlight of the liquid crystal panel.

In the technical solutions above, preferably the step 204 includes: storing amounts of image information and backlight gain coefficients in correspondence with each other, and retrieving the backlight gain coefficient according to the determined amount of image information. In the technical solution, amounts of image information and backlight gain coefficients are created in correspondence with each other.

In the technical solutions above, preferably the method can further include a step 210 of compensating the received video signal according to the gained backlight value and then outputting the video signal to the liquid crystal panel.

In the technical solutions above, preferably in the step 206, the gained backlight value) is calculated according to an equation of: $f(x)=k(\alpha)\times x$ wherein $f(x)$ represents the gained backlight value, $\alpha$ represents the amount of image information, $k(\alpha)$ represents the backlight gain coefficient, and $x$ represents the extracted backlight value.

The disclosure further provide a storage medium storing a machine readable program to cause a machine to perform the method of controlling backlight of a liquid crystal panel as described in any one of the technical solutions above.

DETAILED DESCRIPTION OF THE INVENTION

In order to make the objects, features and advantages of the invention more apparent, the invention will be further described in details below with reference to the drawings and particular embodiments thereof.

Numerous details have been set forth in the following description for hill understanding of the invention, but the invention can alternatively be embodied in other embodiments than those described here, so the scope of the invention shall not be limited to the particular embodiments disclosed below.

Figure 1:
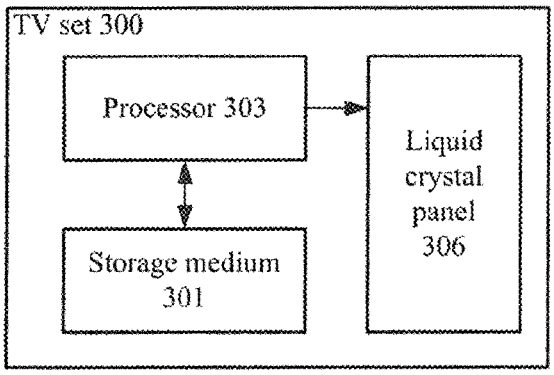
FIG. 1 illustrates a block diagram of a TV set according to an embodiment of the disclosure.

FIG. 1 illustrates a block diagram of a TV set according to an embodiment of the disclosure.

As illustrated in FIG. 1, the TV set 300 includes a liquid crystal panel 306, a processor-readable storage medium 301 storing instruction units for providing the TV set functions to control backlight of the liquid crystal panel; and one or more processors 303 in communication with the storage medium 301 to execute the instruction units.

Figure 2:
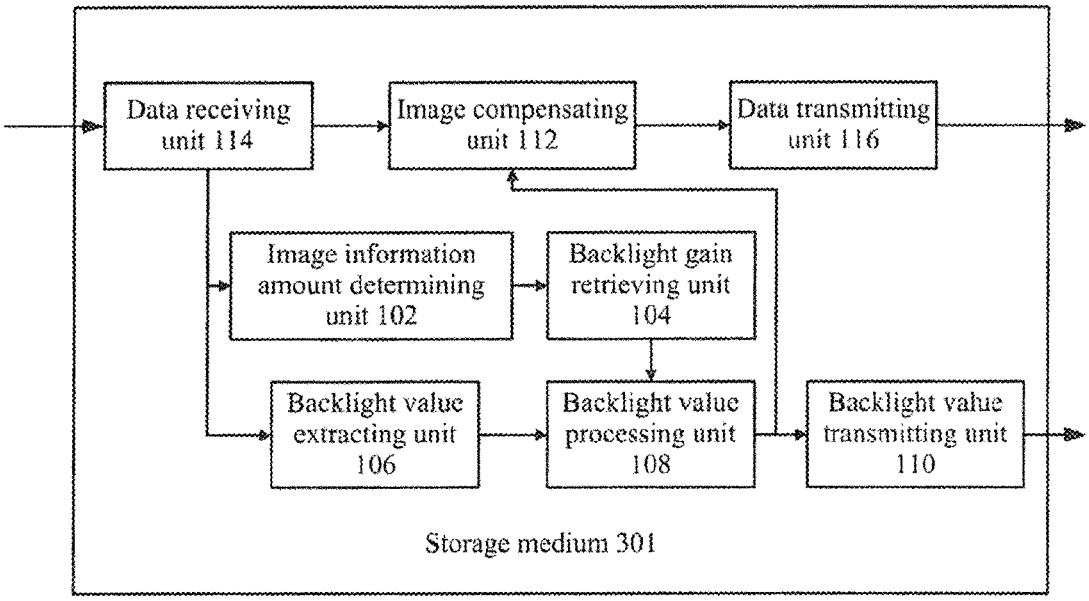
FIG. 2 illustrates a block diagram of instruction units for controlling backlight of a liquid crystal panel according to an embodiment of the disclosure.

FIG. 2 illustrates a block diagram of the instruction units for controlling backlight of a liquid crystal panel according to an embodiment of the disclosure.

As illustrated in FIG. 2, the instruction units for controlling backlight of a liquid crystal panel 100 according to the embodiment of the disclosure includes: an image information amount determining unit 102 configured to determine the amount of image information of an input Video signal (e.g., an image entropy and the size of a white image window) and to transmit the amount of image information to a backlight gain retrieving unit 104; the backlight gain retrieving unit 104, in communication with the image information amount determining unit 102, configured to retrieve a backlight gain coefficient according to the amount of image information; a backlight value extracting unit 106 configured to extract a backlight value of the video signal (reference can be made to FIG. 4 for a particular scheme to extract a backlight value) and to transmit the backlight value to a backlight value processing unit 108; the backlight value processing unit 108, in communication with the backlight value extracting unit 106 and the backlight gain retrieving unit 104, configured to calculate a gained backlight value from the backlight gain coefficient and the backlight value; and a backlight value transmitting unit 110, in communication with the backlight value processing unit 108, configured to transmit the gained backlight value to a light source drive circuit of a liquid crystal panel.

In an example, the amount of image information can be derived according to an equation of:

$$\alpha = \frac{1}{M \cdot N} \sum_{x=1}^{M} \sum_{y=1}^{N} \max(R(x, y), G(x, y), B(x, y))$$

for coordinates of a pixel $(x, y) \epsilon (1:M, 1:N)$.

Where $\alpha$ represents the amount of image information, M and N define boundaries of an image area, and R, G and B represent three color channels of red, green and blue respectively. The cumulative sum of the maximums of pixels R, G and B in a specific region of the image or the entire image on the screen is determined as the amount of image information thereof.

In the technical solution, the backlight value of the video signal is processed according to the retrieved backlight gain coefficient into a backlight value suitable for the corresponding image so that backlight enhancement can be performed on the image with a large amount of information and the difference in brightness between grayscales of the image with a large amount of information can be raised. As such the layered perception and the contrast of the displayed video can be improved effectively.

In the technical solution above, preferably the backlight gain retrieving unit 104 includes a memory (not illustrated) configured to store amounts of image information and backlight gain coefficients in correspondence with each other, and the backlight gain retrieving unit 104 is configured to search the memory for the backlight gain coefficient according to the amount of image information determined by the image information amount determining unit 102.

Figure 3A:
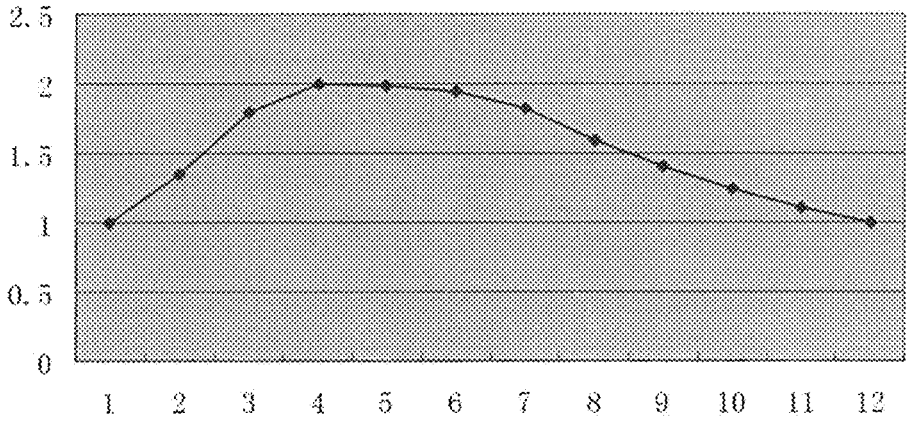
FIG. 3A illustrates a schematic diagram of a backlight gain lookup curve according to an embodiment of the disclosure.
Figure 3B:
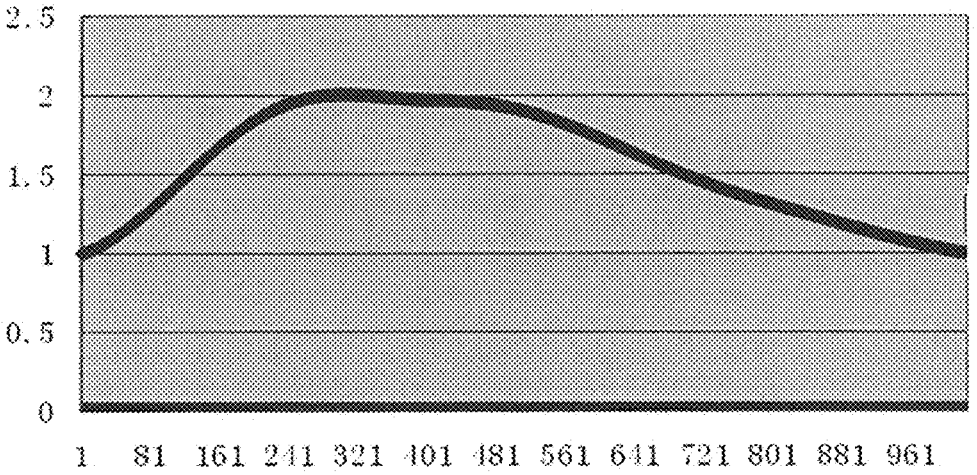
FIG. 3B illustrates an improved schematic diagram of a backlight gain lookup curve according to an embodiment of the disclosure.

In the technical solution, amounts of image information and backlight gain coefficients are stored in correspondence with each other. As such a backlight gain coefficient lookup table can be created, the corresponding backlight gain coefficient is retrieved for the amount of image information, and correspondence relationship data in the backlight gain coefficient lookup table can be updated as needed in reality. Reference can be made to FIG. 3A and FIG. 3B for a particular scheme to retrieve a backlight gain coefficient.

In the technical solution above, preferably the backlight value processing unit is configured to calculate the gained backlight value according to an equation of $f(x)=k(\alpha)\times x$, where $f(x)$ represents the gained backlight value, $\alpha$ represents the amount of image information, $k(\alpha)$ represents the backlight gain coefficient, and x represents the backlight value extracted by the backlight value extracting unit.

In the technical solution, the gained backlight value is the product of the backlight value and the backlight gain coefficient, and since an all-white field is taken as a modulation base point, a stronger backlight value can be derived from the amount of image information.

In the technical solution above, preferably the instruction units further includes an image compensating unit 112, in communication with the backlight processing unit 108, configured to compensate the received video signal according to the received gained backlight value.

In the technical solution, the image needs to be compensated due to a change to the backlight value so as to prevent an obvious change in brightness of the image.

In the technical solution above, preferably the instruction units can further include a data receiving unit 114 and a data transmitting unit 116, where the data receiving unit 114 is in communication with the image information amount determining unit 102, the backlight value extracting unit 106 and the image compensating unit 112, and the data transmitting unit 116 is in communication with the image compensating unit 112, wherein the video signal is received from outside through the data receiving unit 114 and the video signal compensated by the image compensating unit 112 is transmitted to a timing control unit of the liquid crystal panel.

In the technical solution, the video signal is received through the data receiving unit 114 (e.g., an LVDS receiver) and the processed video signal is outputted to a timing control unit of the liquid crystal panel through the data transmitting unit 116 (e.g., an LVDS transmitter).

With the technical solution above, the backlight modulation coefficient can be modulated dynamically according to the amount of image information to perform backlight enhancement on an image with a large amount of information and to raise the difference in brightness between grayscales of the image so as to improve effectively the layered perception and the contrast of the displayed video.

FIG. 3A and FIG. 3B illustrate schematic diagrams of a backlight gain lookup curve according to an embodiment of the disclosure Firstly a reference is defined: an all-white field is typically taken as a reference defined as a modulation coefficient $K_0$. Backlight gain coefficients corresponding to respective amounts of image information can be, derived experimentally and as depicted in Table 1 below, the curve as illustrated in FIG. 3A can be plotted from the data in Table 1, where the abscissa represents the amount of image information and the ordinate represents a backlight gain coefficient in FIG. 3A.

TABLE 1

| Amount of image information | Backlight gain coefficient |
|---|---|
| 1 | 1 |
| 2 | 1.35 |
| 3 | 1.8 |
| 2 | 2 |
| 5 | 1.98 |
| 6 | 1.95 |
| 7 | 1.82 |
| 8 | 1.6 |
| 9 | 1.4 |
| 10 | 1.25 |
| 11 | 1.11 |
| 12 | 1 |

Due to a limited amount of data that can be derived experimentally, the data in the table above can be interpolated into a higher amount of data, and FIG. 3B illustrates a fitting curve as a result of interpolation. Such data is stored in the memory of the backlight gain retrieving unit 104, and the backlight gain retrieving unit 104 can retrieve the backlight gain coefficient according to the amount of image information after the image information amount determining unit 102 determines the amount of image information.

Figure 4:
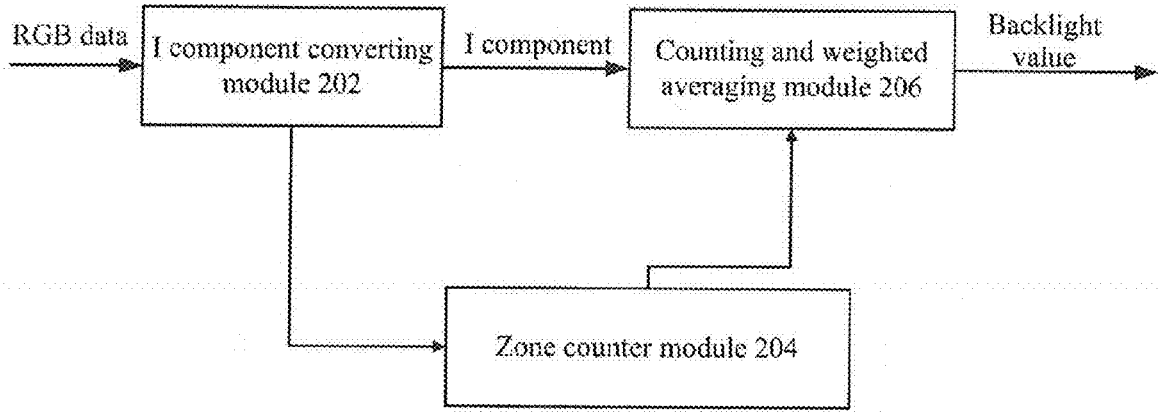
FIG. 4 illustrates a schematic diagram of extraction of a zone backlight value according to an embodiment of the disclosure.

A particular process of extracting a backlight value according to the disclosure will be described below with reference to FIG. 4. FIG. 4 illustrates a schematic diagram of extraction of a zone backlight value according to an embodiment of the disclosure.

As illustrated in FIG. 4, the backlight value extracting unit 106 generally includes three modules: an I-component converting module 202 for RIG/B color space to HSI color space conversion, a zone counter module 204 and a counting and weighted averaging module 206 for averages and maximums in zones. The I-component converting module 202 for R/G/B color space to HSI color space conversion is configured to convert input R/G/B image data into an I component in the HSI color space according to an equation of $$I = \frac{R + G + B}{3},$$

where I, G and B are normalized.

Then the I-component converting module 202 for R/G/B color space to HSI color space conversion is configured to output the I component to the zone counter module 204 and the counting and weighted averaging module 206 for averages and maximums in zones respectively; the zone counter module 204 is configured to record the position of a zone where the component I is located and to provide the position to the counting and weighted averaging module 206 for averages and maximums in zones; and the counting and weighted averaging module 206 for averages and maximums in zones is configured to count the maximum and the average of each zone from information about the I component provided by the zone counter module 204. Finally the maximums and the averages of the zones are further weighted-averaged after backlight values of a frame of image data are counted.

(1) The I-component converting module 202 for R/G/B color space to HSI color space conversion:

A color model (also referred to as a color space) is used to simplify a color specification in a commonly acceptable manner in some standard. In digital image processing, a hardware-oriented model which is the most universal in practice is the RGB (red, green and blue) model. This model is used for a color monitor and a general category of color video cameras. The YUV (analog PAL) (brightness and chromatics R-Y and G-Y) or YCbCr (digital) color space is applied in a modern color TV set. The BSI (hue, saturation and intensity) model is more suitable for a person to describe and explain a color. The HSI color is selected to analyze and count a backlight value in view of the following two aspects: firstly the HSI space is more suitable for perception by human eyes, and if the WV space is used, then a backlight value counted from Y may come with the problem of a loss of blue details due to a low weight of blue converted into Y; and secondly an equation of an I component in R/G/B to HSI space conversion (see Equation 1) is simple and easy to implement $$I = \frac{R + G + B}{3},$$

where I, G and B are normalized (Equation 1).

(2) The zone counter module 204:

It can be configured to divide an LED backlight source into nine zones, each of which is composed of four LEDs driven in series to adjust a bright grayscale separately. Each zone corresponds to pixels in a corresponding area of the liquid crystal panel so that the zone counter module records the position of a zone where the I component is located. Of course the number of zones, and the size and shape of a zone may vary in practical applications. However substantially the same zoning mechanism will apply thereto.

(3) The counting and weighted averaging module 206 for averages and maximums in zones:

The counting and weighted averaging module 206 for averages and maximums in zones is configured to count the maximum and the average of each zone from the information about the I component provided by the zone counter module 204, where typically the counted maximums and averages are stored temporarily in two RAMs in a counting process. Finally the maximums and the averages of the zones are further weighted-averaged after the backlight values of a frame of image data are counted. Particular weight coefficients thereof can be determined according to a system test result.

The principle of the apparatus for controlling backlight of a liquid crystal panel has been described above in details, and a TV set according to the disclosure will be described below with reference to FIG. 4 illustrating a block diagram of a TV set according to an embodiment of the disclosure.

Figure 5:
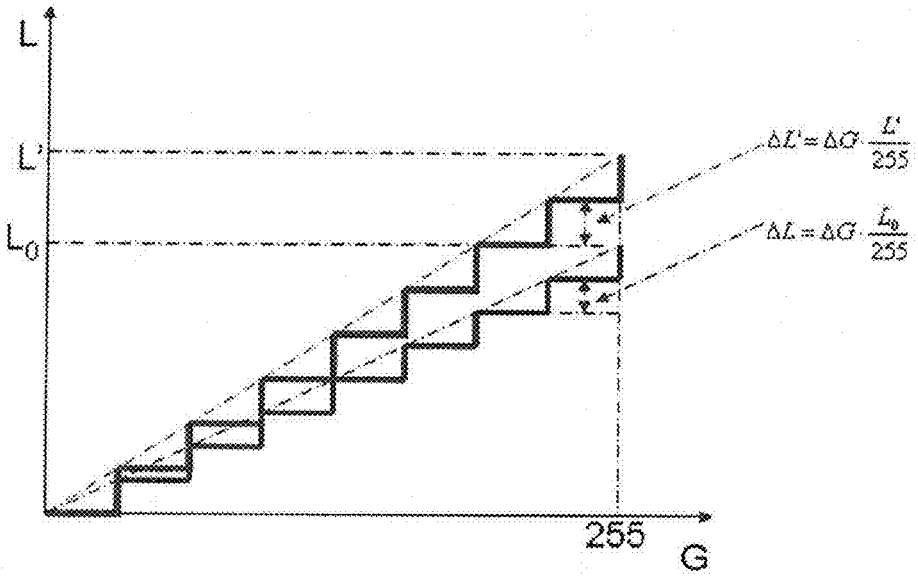
FIG. 5 illustrates a grayscale vs. brightness curve diagram according to an embodiment of the disclosure.

FIG. 5 illustrates a grayscale vs. brightness curve diagram according to an embodiment of the disclosure.

As illustrated in FIG. 5, there is illustrated an 8-bit black step curve. As illustrated, the abscissa G represents a grayscale, and the ordinate L represents a brightness value. L0 represents a brightness value corresponding to the highest grayscale 255 in a relevant backlight modulation technology, and the difference in brightness between grayscales is $$\Delta L = \Delta G \cdot \frac{L_0}{255}.$$

With processing in the liquid crystal panel backlight control technology of the disclosure, L' represents the brightness of enhanced backlight corresponding to the highest grayscale in an image, and $L' > L_0$ indicates significantly enhanced brightness of the image; and the difference in brightness between grayscales is $$\Delta L' = \Delta G \cdot \frac{L'}{255},$$

and $\Delta L' > \Delta L$ indicates an increase in slope of the curve as compared with that prior to processing, which suggests a significant improvement of the layered perception and the contrast of the display image.

The technical solution of the disclosure has been described above in details with reference to the drawings, and in view of the impossibility in the prior art to achieve good layered perception and contrast for a large amount of image information in backlight modulation according to a cumulative brightness value of an image, the disclosure proposes a novel liquid crystal panel backlight control technology in which a backlight modulation coefficient can be modulated dynamically according to the amount of image information to perform backlight enhancement on an image with a large amount of information and to raise the difference in brightness between grayscales of the image so as to improve effectively the layered perception and the contrast of a displayed video.

The disclosure further provide a program product, stored on a non-transitory machine readable medium, for controlling backlight of a liquid crystal panel, the program product including machine executable instructions to cause a computer system to perform the steps of determining the amount of image information of an input video signal and extracting a backlight value of the video signal; retrieving a backlight gain coefficient according to the amount of image information; calculating a gained backlight value from the backlight gain coefficient and the backlight value; and transmitting the gained backlight value to a light source drive circuit of the liquid crystal panel to control backlight of the liquid crystal panel.

The disclosure further provide a non-transitory machine readable medium storing a program product for controlling backlight of a liquid crystal panel, the program product including machine executable instructions to cause a computer system to perform the steps of determining the amount of image information of an input video signal and extracting a backlight value of the video signal; retrieving a backlight gain coefficient according to the amount of image information; calculating a gained backlight value from the backlight gain coefficient and the backlight value; and transmitting the gained backlight value to a light source drive circuit of the liquid crystal panel to control backlight of the liquid crystal panel.

The disclosure further provide a machine readable program to cause a machine to perform the method of controlling backlight of a liquid crystal panel as described in any one of the technical solutions above.

The disclosure further provide a storage medium storing a machine readable program to cause a machine to perform the method of controlling backlight of a liquid crystal panel as described in any one of the technical solutions above.

In the disclosure, the terms "install", "in communication", "connect", "fix", etc., shall be interpreted broadly unless other stated and defined expressly, for example, they can relate to fixed connection or removable connection or integral connection; or can be mechanical connection or electrical connection; or can be direct connection or indirect connection via an intermediate medium; or can relate to two elements connected internal thereto. Those ordinarily skilled in the art can learn the particular meanings of the terms in the disclosure dependent upon a practical scenario.

The foregoing disclosure is merely illustrative of the preferred embodiments of the disclosure but not intended to limit the invention, and those skilled in the art can make various modifications and variations thereto. Any modifications, equivalent substitutions, adaptations, etc., made without departing from the sprit and the principle of the invention shall come into the scope of the invention.

The invention claimed is:

1. A TV set, comprising:

a liquid crystal panel;

a processor-readable storage medium storing instructions for providing the TV set functions to control backlight of the liquid crystal panel; and one or more processors in communication with the storage medium to execute the instructions, wherein the execution of the instructions by the one or more processor causes the one or more processor to perform:

determining an amount of image information which is a cumulative average of maximums of pixels in R, G and B channels at a coordinate of each pixel in a region of an image or a cumulative average of maximums of pixels in R, G and B channels at a coordinate of each pixel in entirety of the image, of a video signal inputted and extracting a backlight value of the video signal;

retrieving a backlight gain coefficient according to the amount of image information;

calculating a gained backlight value from the backlight gain coefficient and the backlight value; and transmitting the gained backlight value to a light source drive circuit of the liquid crystal panel:

wherein the amount of image information is derived according to an equation of:

$$\alpha = \frac{1}{M \cdot N} \sum_{x=1}^{M} \sum_{y=1}^{N} \max(R(x, y), G(x, y), B(x, y))$$

for coordinates of a pixel (x, y)∈(1:M, 1:N);

wherein α represents the amount of image information, M and N define boundaries of an area of the region of the image or the entirety of the image, and R, G and B represent three color channels of red, green and blue respectively.

2. The TV set according to claim 1, wherein the execution of the instructions by the one or more processor causes the one or more processor to retrieve the backlight gain coefficient according to the amount of image information by:

storing amounts of image information and backlight gain coefficients in correspondence with each other, and retrieving the backlight gain coefficient according to the determined amount of image information.

3. The TV set according to claim 1, wherein the execution of the instructions by the one or more processor causes the one or more processor to calculate the gained backlight value according to an equation of f(x)=k(α)×x, wherein f(x) represents the gained backlight value, α represents the amount of image information, k(α) represents the backlight gain coefficient, and x represents extracted backlight value.

4. The TV set according to claim 1, wherein the execution of the instructions by the one or more processor causes the one or more processor to further perform:

compensating the video signal according to the gained backlight value.

5. The TV set according to claim 4, wherein the execution of the instructions by the one or more processor causes the one or more processor to further perform:

receiving the video signal from outside;

transmitting the video signal compensated by the image compensating unit to a timing control unit of the liquid crystal panel.

6. A method of controlling backlight of a liquid crystal panel, comprising:

determining an amount of image information which is a cumulative average of maximums of pixels in R, G and B channels at a coordinate of each pixel in a region of an image or a cumulative average of maximums of pixels in R, G and B channels at a coordinate of each pixel in entirety of the image, of a video signal inputted and extracting a backlight value of the video signal;

retrieving a backlight gain coefficient according to the amount of image information;

calculating a gained backlight value from the backlight gain coefficient and the backlight value; and transmitting the gained backlight value to a light source drive circuit of the liquid crystal panel to control backlight of the liquid crystal panel;

wherein the amount of image information is derived according to an equation of:

$$\alpha = \frac{1}{M \cdot N} \sum_{x=1}^{M} \sum_{y=1}^{N} \max(R(x, y), G(x, y), B(x, y))$$

for coordinates of a pixel (x, y)∈(1:M, 1:N);

wherein α represents the amount of image information, M and N define boundaries of an area of the region of the image or the entirety of the image, and R, G and B represent three color channels of red, green and blue respectively.

7. The method according to claim 6, wherein the retrieving the backlight gain coefficient according to the amount of image information comprises: storing amounts of image information and backlight gain coefficients in correspondence with each other, and retrieving the backlight gain coefficient according to the determined amount of image information.

8. The method according to claim 6, further comprising:

compensating the video signal according to the gained backlight value and then outputting to the liquid crystal panel.

9. The method according to claim 6, wherein the gained backlight value is calculated according to an equation of f(x)=k(α)×x, wherein f(x) represents the gained backlight value, α represents the amount of image information, k(α) represents the backlight gain coefficient, and x represents the extracted backlight value.

10. The method according to claim 7, wherein the gained backlight value is calculated according to an equation of f(x)=k(α)×x, wherein f(x) represents the gained backlight value, α represents the amount of image information, k(α) represents the backlight gain coefficient, and x represents the extracted backlight value.

11. The method according to claim 8, wherein the gained backlight value is calculated according to an equation of f(x)=k(α)×x, wherein f(x) represents the gained backlight value, α represents the amount of image information, k(α) represents the backlight gain coefficient, and x represents the extracted backlight value.

12. A non-transitory processor-readable storage medium, storing a set of instructions, wherein the set of instructions, when executed by one or more processors, cause the one or more processors to perform a method of controlling backlight of a liquid crystal panel, the method comprising:

determining an amount of image information which is a cumulative average of maximums of pixels in R, G and B channels at a coordinate of each pixel in a region of an image or a cumulative average of maxiums of pixels in R, G and B channels at a coordinate of each pixel in entirety of the image, of a video signal inputted and extracting a backlight value of the video signal;

retrieving a backlight gain coefficient according to the amount of image information;

calculating a gained backlight value from the backlight gain coefficient and the backlight value; and transmitting the gained backlight value to a light source drive circuit of the liquid crystal panel to control backlight of the liquid crystal panel;

wherein the amount of image information is derived according to an equation of:

$$\alpha = \frac{1}{M \cdot N} \sum_{x=1}^{M} \sum_{y=1}^{N} \max(R(x, y), G(x, y), B(x, y))$$

for coordinates of a pixel (x, y)∈(1:M, 1:N);

wherein α represents the amount of image information, M and N define boundaries of an area of the region of the image or the entirety of the image, and R, G and B represent three color channels of red, green and blue respectively.

13. The non-transitory processor-readable storage medium according to claim 12, wherein the retrieving the backlight gain coefficient according to the amount of image information comprises: storing amounts of image information and backlight gain coefficients in correspondence with each other, and retrieving the backlight gain coefficient according to the determined amount of image information.

14. The non-transitory processor-readable storage medium according to claim 12, the method further comprising:

compensating the video signal according to the gained backlight value and then outputting to the liquid crystal panel.

15. The non-transitory processor-readable storage medium according to claim 12, wherein the gained backlight value is calculated according to an equation of $f(x)=k(\alpha)\times x$, wherein $f(x)$ represents the gained backlight value, $\alpha$ represents the amount of image information, $k(\alpha)$ represents the backlight gain coefficient, and $x$ represents the extracted backlight value.

* * * * *